US010227837B2

(12) United States Patent
Anderson et al.

(10) Patent No.: US 10,227,837 B2
(45) Date of Patent: Mar. 12, 2019

(54) DRILLING WASTE TREATMENT

(75) Inventors: Trey W. Anderson, Pearland, TX (US); Gary E. Fout, Cypress, TX (US); Gordon MacMillian Logan, Aberdeen (GB); John Koch, Houston, TX (US)

(73) Assignee: M-I L.L.C., Houston, TX (US)

( * ) Notice: Subject to any disclaimer, the term of this patent is extended or adjusted under 35 U.S.C. 154(b) by 406 days.

(21) Appl. No.: 14/114,483

(22) PCT Filed: Apr. 27, 2012

(86) PCT No.: PCT/US2012/035487

§ 371 (c)(1),
(2), (4) Date: Feb. 13, 2014

(87) PCT Pub. No.: WO2012/149345

PCT Pub. Date: Nov. 1, 2012

(65) Prior Publication Data

US 2014/0158431 A1 Jun. 12, 2014

Related U.S. Application Data

(60) Provisional application No. 61/480,776, filed on Apr. 29, 2011.

(51) Int. Cl.

| | |
|---|---|
| ***E21B 21/01*** | (2006.01) |
| ***E21B 41/00*** | (2006.01) |
| ***E21B 21/06*** | (2006.01) |

(52) U.S. Cl.

CPC ..... *E21B 21/01* (2013.01); *E21B 21/065* (2013.01); *E21B 21/066* (2013.01); *E21B 41/005* (2013.01); *Y10T 137/87571* (2015.04)

(58) Field of Classification Search

CPC ..... E21B 21/01; E21B 21/015; E21B 21/06; E21B 21/062; E21B 21/066; E21B 21/068; E21B 41/005

See application file for complete search history.

(56) References Cited

U.S. PATENT DOCUMENTS

| | | | | |
|---|---|---|---|---|
| 2,852,091 A * | 9/1958 | Boudreaux | E21B 21/067 175/206 |
| 5,154,234 A * | 10/1992 | Carrico | A62C 3/06 169/46 |
| 5,996,484 A * | 12/1999 | Reddoch | B30B 9/12 100/106 |
| 6,213,227 B1 * | 4/2001 | Dietzen | B63B 27/20 175/206 |

(Continued)

FOREIGN PATENT DOCUMENTS

| | | |
|---|---|---|
| WO | 9313291 A1 | 7/1993 |
| WO | 2011036556 A2 | 3/2011 |

OTHER PUBLICATIONS

Examiner's Report issued in related CA application 2834568 dated Jul. 20, 2015, 4 pages.

(Continued)

*Primary Examiner* — D. Andrews

(74) *Attorney, Agent, or Firm* — Paula B. Whitten

(57) ABSTRACT

A method transferring drill cuttings, the method comprising transferring the drill cuttings from a pressurized transference device to a pressurized container; transferring the drill cuttings from the pressurized container to a land-based pit discharging station; and discharging the drill cuttings into the land-based pit discharging station. Also, a system for transferring drill cuttings while drilling, the system comprising a pressurized transfer device; a pressurized container in fluid communication with the pressurized transfer device; a conduit disposed between the pressurized transfer device and the pressurized container; and a land-based pit discharging station in fluid communication with the pressurized container.

22 Claims, 11 Drawing Sheets

(56) References Cited

U.S. PATENT DOCUMENTS

| | | | | |
|---|---|---|---|---|
| 6,715,610 | B2 | 4/2004 | Wait et al. | |
| 7,033,124 | B2 | 4/2006 | Snowdon | |
| 2004/0178003 | A1* | 9/2004 | Riet | E21B 21/08 175/57 |
| 2006/0102390 | A1* | 5/2006 | Burnett | B63B 27/20 175/66 |
| 2007/0187432 | A1 | 8/2007 | Snowdon | |
| 2008/0087472 | A1 | 4/2008 | Fout | |
| 2008/0210466 | A1 | 9/2008 | McDonald et al. | |
| 2010/0133368 | A1 | 6/2010 | Christensen | |

OTHER PUBLICATIONS

Office Action issued in related EA application 201391603 dated Aug. 10, 2015, 3 pages.

International Search Report of PCT/US2012/035487 dated Sep. 20, 2012.

Office Action issued in Eurasian Application No. 201391603; dated Nov. 15, 2016 with English reporting letter (4 pages).

Office Action for the equivalent Canadian patent application 2834568 dated Sep. 25, 2014.

Office Action for the equivalent Chinese patent application 201280020963.7 dated Oct. 8, 2015.

Office Action for the equivalent Canadian patent application 2834568 dated Feb. 19, 2016.

Office Action for the equivalent Chinese patent application 201280020963.7 dated Jun. 14, 2016.

Office Action for the equivalent Chinese patent application 201280020963.7 dated Mar. 13, 2017.

Office Action for the equivalent Canadian patent application 2834568 dated Apr. 10, 2017.

* cited by examiner

DRILLING WASTE TREATMENT

BACKGROUND

Field of the Invention

Embodiments disclosed herein relate to systems and methods of transporting drill cuttings at a drill site. More specifically, embodiments disclosed herein related to systems and methods for transporting and treating cuttings at a drill site. More specifically still, embodiments disclosed herein relate to systems and methods for transporting and treating cuttings at a drill site at a centralized location.

Background Art

When drilling or completing wells in earth formation, various fluids ("well fluids") are typically used in the well for a variety of reasons. Common uses for well fluids include: lubrication and cooling of drill bit cutting surfaces while drilling generally or drilling-in (i.e., drilling in a targeted petroleum bearing formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stability the formation through which the well is being drilled, fracturing the formation in the vicinity of the well, displacing the fluid within the well with another fluid, cleaning the well, testing the well, emplacing a packer fluid, abandoning the well or preparing the well for abandonment, and otherwise treating the well for the formation.

In a typical drilling operation, well fluids are pumped downhole to lubricate the drill bit and carry away well cuttings generated by the drill bit. The cuttings are carried to the surface in a return flow stream of well fluids through the well annulus and back to the rig or well drilling platform at the earth surface. When the drilling fluid reaches the surface, it is contaminated with small pieces of shale and rock drill cuttings. As the well fluid is returned to the surface, drill cuttings are separated from reusable fluid by commonly known vibratory separators (i.e., shale shakers). Typically, well fluid is cleaned (i.e., the particulate matter is separated from reusable fluids) so that the cuttings may be discarded in accordance with environmental regulations and the drilling fluids may be recycled in the drilling operation. Vibratory separators, one such cleaning method, are designed to filter solid material from the well fluids such that cuttings are removed from the fluid, prior to the fluid being pumped back downhole. Cleaning the cuttings via vibratory separators is only one cleaning process that cuttings may undergo. Certain drilling operations may use additional cleaning processes, such as, for example, use of centrifuges to further remove oil and other well fluids from the cuttings. The cleaning process is generally continuous with drilling of the well. Thus, as long as the well is being drilled, well fluid contaminated with cuttings is returned to the surface.

Presently, front end loaders are used at a drilling site to move cuttings to various locations at the drill site. For example, cuttings may be moved from rig side mud pits to reserve pits or between various treatment locations. Front end loaders are often a hazard at a drilling location, as the front end loaders may cause injury to personnel due to tipping over and/or otherwise injuring the personnel.

Accordingly, there exists a need for safer methods of transporting and treating cuttings at a drill site.

SUMMARY OF THE DISCLOSURE

In one aspect, embodiments disclosed herein relate to a method transferring drill cuttings, the method comprising transferring the drill cuttings from a pressurized transference device to a pressurized container; transferring the drill cuttings from the pressurized container to a land-based pit discharging station; and discharging the drill cuttings into the land-based pit discharging station.

In another aspect, embodiments disclosed herein relate to a system for transferring drill cuttings while drilling, the system comprising a pressurized transfer device; a pressurized container in fluid communication with the pressurized transfer device; a conduit disposed between the pressurized transfer device and the pressurized container; and a land-based pit discharging station in fluid communication with the pressurized container.

Other aspects and advantages of the invention will be apparent from the following description and the appended claims.

DETAILED DESCRIPTION

In one aspect, embodiments disclosed herein relate generally to systems and methods of transporting drill cuttings at a drill site. More specifically, embodiments disclosed herein related to systems and methods for transporting and treating cuttings at a drill site. More specifically still, embodiments disclosed herein relate to systems and methods for transporting and treating cuttings at a drill site at a centralized location.

As a wellbore is drilled at a drilling location, drill cuttings are generated and eventually must be disposed of. Those of ordinary skill in the art will appreciate that as used herein, "a drilling location" refers to an area of land that has at least one well thereon. Additionally, the drilling location may include a plurality of wells, as well as a single well with other wells planned or in progress of being drilled. As explained above, traditionally, in land-based drilling operations the drill cuttings are moved around the drilling location using front-loaders, trucks, drill cutting boxes, and the like, in order to transport the drill cuttings to a disposal location. In certain land-based drilling operations, the drill cuttings may be temporarily stored at the drilling location prior to being transported to a second, disposal location.

Embodiments of the present disclosure provide for systems and methods of transporting the drill cuttings at a land-based drilling operation in a more safe and efficient manner through the use of pressurized drill cuttings transference. Additionally, embodiments of the present disclosure provide pneumatic systems and methods for transferring the drill cuttings to a centralized discharging station.

Figure 1:
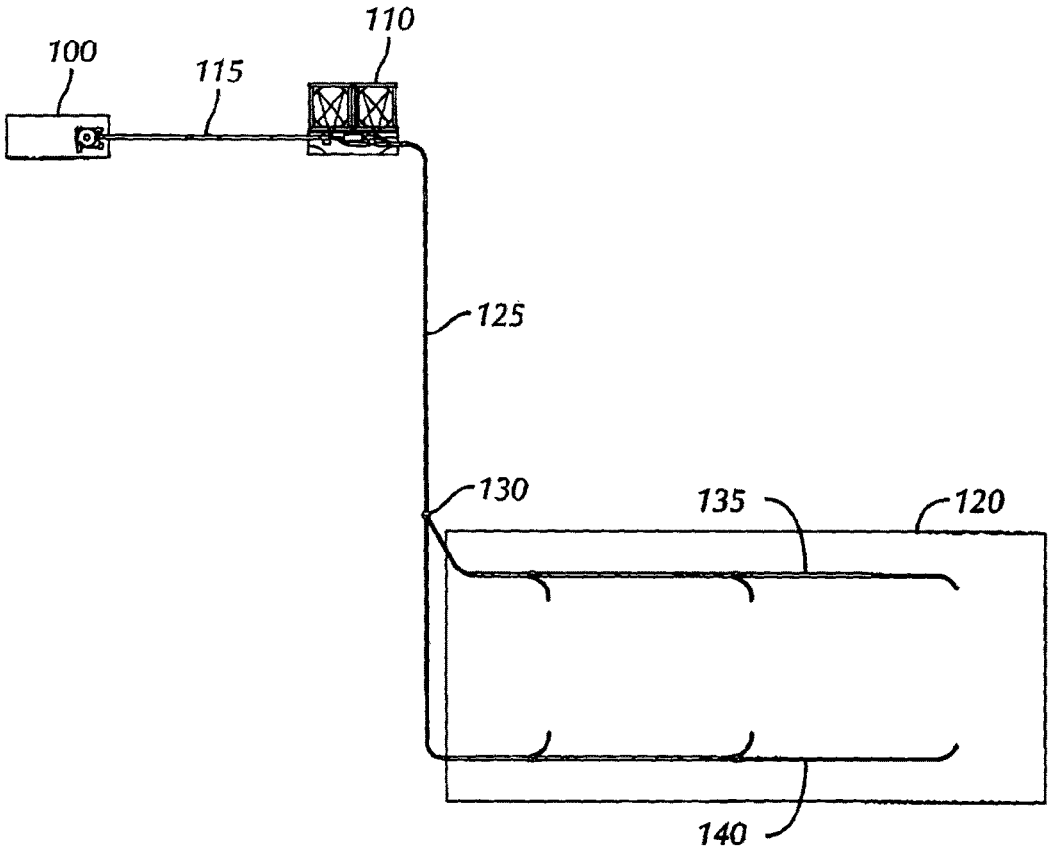
FIG. 1 is a schematic representation of a system for transporting drill cuttings at a land-based drilling location according to embodiments of the present disclosure.

Referring initially to FIG. 1, a schematic representation of a system for transporting drill cuttings at a land-based drilling location is shown. In this embodiment, drill cuttings are disposed in a pressurized transfer device 100. One example of a commercially available pressurized transfer device 100 is the CleanCut Cuttings Blower, commercially available from M-I L.L.C., a Schlumberger Company, Houston, Tex.

Figure 2:
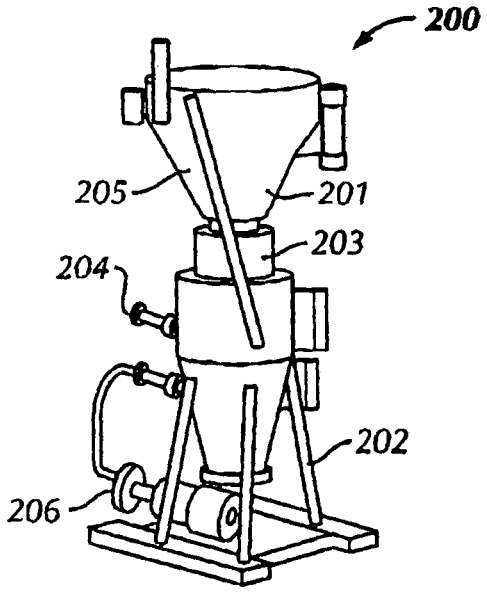
FIG. 2 is a perspective view of a pressurized transference device according to embodiments of the present disclosure.

Referring briefly to FIG. 2, an exemplary pressurized transfer device 100 is discussed in detail. FIG. 2 shows a side perspective view of a pressurized transfer device. Pressurized transference device 200 may include a feed chute 201 through which drill cuttings may be gravity fed. After the drill cuttings have been loaded into the body 202 of the device, an inlet valve 203 is closed, thereby creating a pressure-tight seal around the inlet. Once sealed, the body 202 is pressurized, and compressed air may be injected through air inlet 204, such that the drill cuttings in body 202 are discharged from the pressurized transference device in a batch. In certain aspects, pressurized transference device 200 may also include secondary air inlet 205 and/or vibration devices (not shown) disposed in communication with feed chute 201 to facilitate the transfer of material through the feed chute 201 by breaking up coalesced materials.

During operation, the pressurized transference device 200 may be fluidly connected to pressurized containers, as will be discussed in detail below, thereby allowing drill cuttings to be transferred therebetween. Because the materials are transferred in batch mode, the materials travel in slugs, or batches of material, through a hose connected to an outlet 206 of the pressurized transference device 200. Such a method of transference is a form of dense phase transfer, whereby materials travel in slugs, rather than flow freely through hoses, as occurs with traditional, lean phase material transfer.

Referring back to FIG. 1, after drill cuttings are loaded into pressurized transfer device 100, the drill cuttings are transferred to pressurized containers 110. Pressurized containers 110 may include varying designs and configurations, so long as the pressurized containers 110 allow for the pneumatic transference of drill cuttings. More specifically, the pressurized containers 110 are configured to allow for the positive pneumatic transference 110 of materials between a first pressurized container 110 and a second container, whether the second container is a second pressurized container (not shown) or includes an atmospheric receiving chamber, which will be discussed in detail below. Several examples of pressurized containers 110 that may be used according to embodiments of the present disclosed are discussed in detail below.

Figure 3A:
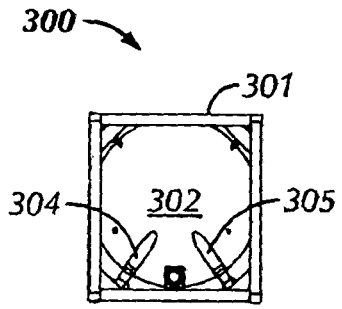
FIG. 3A is a top view of a pressurized container according to embodiments of the present disclosure.
Figure 3B:
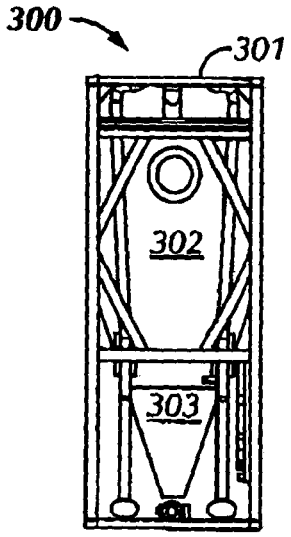
FIG. 3B is a side view a pressurized container according to embodiments of the present disclosure.
Figure 3C:
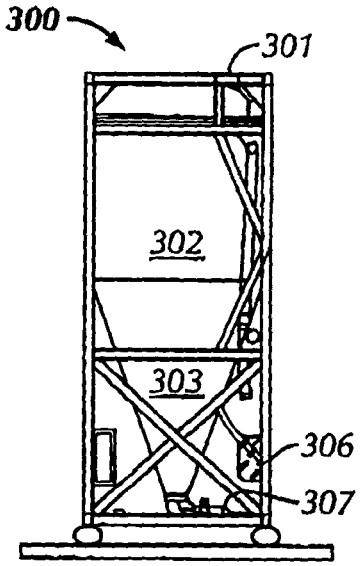
FIG. 3C is a side view of a pressurized container according to embodiments of the present disclosure.

Referring to FIGS. 3A through 3C, a pressurized container according to embodiments of the present disclosure is shown. FIG. 3A is a top view of a pressurized container, while FIGS. 3B and 3C are side views. One type of pressurized vessel that may be used according to aspects disclosed herein includes an ISO-PUMP™, commercially available from M-I L.L.C, a Schlumberger Company, Houston, Tex. In such an embodiment, a pressurized container 300 may be enclosed within a support structure 201. Support structure 301 may hold pressurized container 300 to protect and/or allow the transfer of the container from, for example, a supply boat to a production platform. Generally, pressurized container 300 includes a vessel 302 having a lower angled section 203 to facilitate the flow of drill cuttings between pressurized container 300 and other processing and/or transfer equipment (not shown). A further description of pressurized containers 300 that may be used with embodiments of the present disclosure is discussed in U.S. Pat. No. 7,033,124, assigned to the assignee of the present application, and hereby incorporated by reference herein. Those of ordinary skill in the art will appreciate that alternate geometries of pressurized containers 300, including those with lower sections that are not conical, may be used in certain embodiments of the present disclosure.

Pressurized container 300 also includes a material inlet 304 for receiving drill cuttings, as well as an air inlet and outlet 305 for injecting air into the vessel 302 and evacuating air to atmosphere during transference. Certain containers may have a secondary air inlet 306, allowing for the injection of small bursts of air into vessel 302 to break apart dry materials therein that may become compacted due to settling. In addition to inlets 304, 305, and 306, pressurized container 300 includes an outlet 307 through which drill cuttings may exit vessel 302. The outlet 307 may be connected to flexible hosing, thereby allowing pressurized container 300 to transfer materials, such as drill cuttings, between pressurized containers 300 or containers at atmosphere.

Figure 4A:
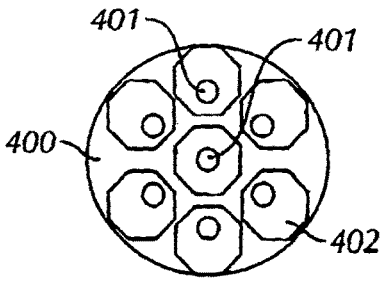
FIG. 4A is a cross-sectional view of a pressurized container according to embodiments of the present disclosure.
Figure 4B:
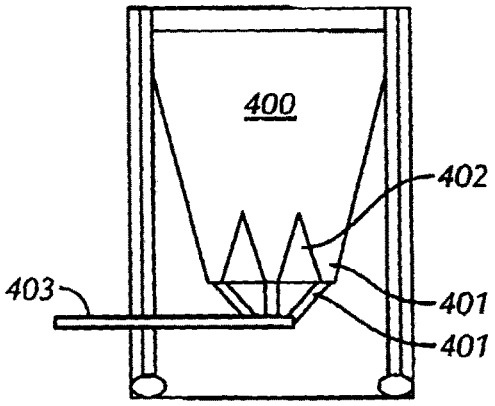
FIG. 4B is a side view of a pressurized container according to embodiments of the present disclosure.
Figure 4C:
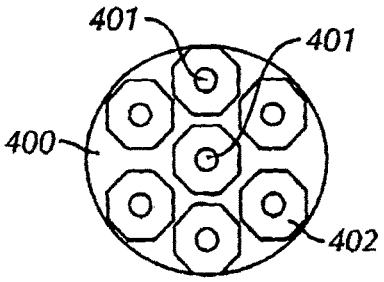
FIG. 4C is a cross-sectional view of a pressurized container according to embodiments of the present disclosure.
Figure 4D:
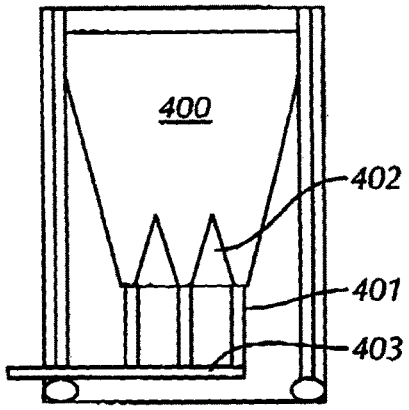
FIG. 4D is a side view of a pressurized container according to embodiments of the present disclosure.

Referring to FIGS. 4A through 4D, a pressurized container 400 according to embodiments of the present disclosure is shown. FIGS. 4A and 4C show top views of the pressurized container 400, while FIGS. 4B and 4D show side views of the pressurized container 400.

Referring now specifically to FIG. 4A, a top schematic view of a pressurized container 400 according to an aspect of the present disclosure is shown. In this embodiment, pressurized container 400 has a circular external geometry and a plurality of outlets 401 for discharging drill cuttings therethrough. Additionally, pressurized container 400 has a plurality of internal baffles 402 for directing a flow of drill cuttings to a specific outlet 401. For example, as drill cuttings are transferred into pressurized container 400, the materials may be divided into a plurality of discrete streams, such that a certain volume of material is discharged through each of the plurality of outlets 401. Thus, pressurized container 400 having a plurality of baffles 402, each corresponding to one of outlets 401, may increase the efficiency of discharging drill cuttings from pressurized container 400.

During operation, drill cuttings transferred into pressurized container 400 may exhibit plastic behavior and begin to coalesce. In traditional transfer vessels having a single outlet, the coalesced materials could block the outlet, thereby preventing the flow of materials therethrough. However, the present embodiment is configured such that even if a single outlet 401 becomes blocked by coalesced material, the flow of material out of pressurized container 400 will not be completely inhibited. Moreover, baffles 402 are configured to help prevent drill cuttings from coalescing. As the materials flow down through pressurized container 400, the material will contact baffles 402, and divide into discrete streams. Thus, the baffles 402 that divide materials into multiple discrete streams may further prevent the material from coalescing and blocking one or more of outlets 401.

Referring to FIG. 4B, a cross-sectional view of pressurized container 400 from FIG. 4A according to one aspect of the present disclosure is shown. In this aspect, pressurized container 400 is illustrated including a plurality of outlets 401 and a plurality of internal baffles 402 for directing a flow of drill cuttings through pressurized container 400. In this aspect, each of the outlets 401 are configured to flow into a discharge line 403. Thus, as materials flow through pressurized container 400, they may contact one or more of baffles 402, divide into discrete streams, and then exit through a specific outlet 401 corresponding to one or more of baffles 402. Such an embodiment may allow for a more efficient transfer of material through pressurized container 400.

Referring now to FIG. 4C, a top schematic view of a pressurized container 400 according to one embodiment of the present disclosure is shown. In this embodiment, pressurized container 400 has a circular external geometry and a plurality of outlets 401 for discharging drill cuttings therethrough. Additionally, pressurized container 400 has a plurality of internal baffles 422 for directing a flow of material to a specific one of outlets 401. For example, as materials are transferred into pressurized container 400, the material may be divided into a plurality of discrete streams, such that a certain volume of material is discharged through each of the plurality of outlets 401. Pressurized container 400 having a plurality of baffles 402, each corresponding to one of outlets 401, may be useful in discharging drill cuttings from pressurized container 400.

Referring to FIG. 4D, a cross-sectional view of pressurized container 400 from FIG. 4C according to one aspect of the present disclosure is shown. In this aspect, pressurized container 400 is illustrated including a plurality of outlets 401 and a plurality of internal baffles 402 for directing a flow of drill cuttings through pressurized container 400. In this embodiment, each of the outlets 401 is configured to flow discretely into a discharge line 403. Thus, as materials flow through pressurized container 400, they may contact one or more of baffles 402, divide into discrete streams, and then exit through a specific outlet 401 corresponding to one or more of baffles 402. Such an embodiment may allow for a more efficient transfer of materials through pressurized container 400.

Because outlets 401 do not combine prior to joining with discharge line 403, the blocking of one or more of outlets 401 due to coalesced material may be further reduced. Those of ordinary skill in the art will appreciate that the specific configuration of baffles 402 and outlets 401 may vary without departing from the scope of the present disclosure. For example, in one embodiment, a pressurized container 400 having two outlets 401 and a single baffle 402 may be used, whereas in other embodiments a pressurized container 400 having three or more outlets 401 and baffles 402 may be used. Additionally, the number of baffles 402 and/or discrete streams created within pressurized container 400 may be different from the number of outlets 401. For example, in one aspect, pressurized container 400 may include three baffles 402 corresponding to two outlets 401. In other embodiments, the number of outlets 401 may be greater than the number of baffles 402.

Moreover, those of ordinary skill in the art will appreciate that the geometry of baffles 402 may vary according to the design requirements of a given pressurized container 400. In one aspect, baffles 402 may be configured in a triangular geometry, while in other embodiments, baffles 402 may be substantially cylindrical, conical, frustoconical, pyramidal, polygonal, or of irregular geometry. Furthermore, the arrangement of baffles 402 in pressurized container 400 may also vary. For example, baffles 402 may be arranged concentrically around a center point of the pressurized container 400, or may be arbitrarily disposed within pressurized container 400. Moreover, in certain embodiments, the disposition of baffles 402 may be in a honeycomb arrangement, to further enhance the flow of materials therethrough.

Those of ordinary skill in the art will appreciate that the precise configuration of baffles 402 within pressurized container 400 may vary according to the requirements of a transfer operation. As the geometry of baffles 402 is varied, the geometry of outlets 401 corresponding to baffles 402 may also be varied. For example, as illustrated in FIGS. 4A-4D, outlets 401 have a generally conical geometry. In other embodiments, outlets 401 may have frustoconical, polygonal, cylindrical, or other geometry that allows outlet 401 to correspond to a flow of drill cuttings in pressurized container 402.

Figure 5A:
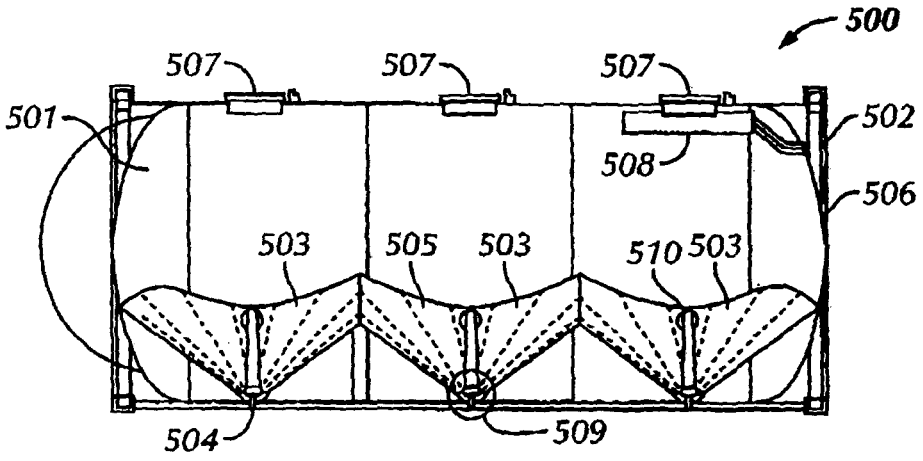
FIG. 5A is a side view of a pressurized container according to embodiments of the present disclosure.
Figure 5B:
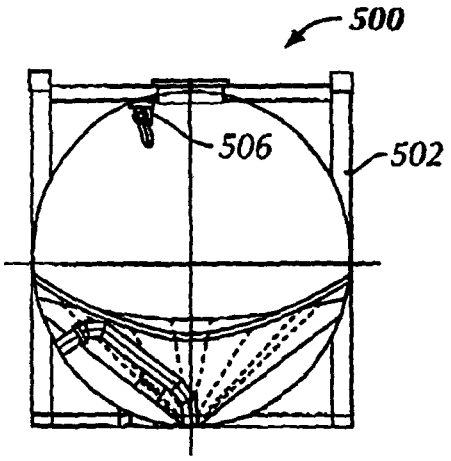
FIG. 5B is an end view of a pressurized container according to embodiments of the present disclosure.

Referring now to FIGS. 5A through 5B, alternate pressurized containers according to aspects of the present disclosure are shown. Specifically, FIG. 5A illustrates a side view of a pressurized container, while FIG. 5B shows an end view of a pressurized container.

In this aspect, pressurized container 500 includes a vessel 501 disposed within a support structure 502. The vessel 501 includes a plurality of conical sections 503, which end in a flat apex 504, thereby forming a plurality of exit hopper portions 505. Pressurized container 500 also includes an air inlet 506 configured to receive a flow of air and material inlets 507 configured to receive a flow of materials, such as drill cuttings. During the transference of materials to and/or from pressurized container 500, air is injected into air inlet 506, and passes through a filtering element 508. Filtering element 508 allows for air to be cleaned, thereby removing dust particles and impurities from the airflow prior to contact with the material within the vessel 501. A valve 509 at apex 504 may then be opened, thereby allowing for a flow of materials from vessel 501 through outlet 510. Examples of horizontally disposed pressurized containers 500 are described in detail in U.S. Patent Publication No. 2007/0187432 to Brian Snowdon, and is hereby incorporated by reference.

Referring back to FIG. 1, in order to provide fluid communication between pressurized transfer device 100 and pressurized container 110, a conduit 115 may be disposed therebetween. Conduit 115 may include various types of conduits known in the art, such as metal, plastic, or rubber tubing and/or pipes. Those of ordinary skill in the art will appreciate that the diameter of conduit 115 may vary depending on the types of pressurized transfer devices 100 and/or pressurized containers 110 that are used. Additionally, the material conduit 115 is formed from may also vary depending on the types of pressurized transfer devices 100 and/or pressurized containers 110 that are used. In certain embodiments multiple lengths of conduit 115 may be used in order to vary the length of conduit 115.

After the drill cuttings are transferred from pressurized transfer device 100 to pressurized container 110, pressurized container may be used, as described above, in order to transfer the drill cuttings from pressurized container to a land-based pit discharging station 120. Land-based pit discharging station 120 may include various design components and be disposed above or in the ground. For example, in one embodiment land-based pit discharging station 120 may be a pit dug into the ground. In such an embodiment, the land-based pit discharging station 120 may be lined with a substantially non-permeable liner in order to prevent residual contaminants from the drill cuttings from leaching into the ground. In alternate embodiments, the land-based pit discharging station 120 may include a non-permeable layer, such as concrete, to prevent contaminants from leaching into the ground. In still other embodiments, land-based pit discharging station 120 may include a metal structure, such as a drill cuttings box (not independently shown), into which drill cuttings may be either temporarily or permanently stored. Those of ordinary skill in the art will appreciate that various designs of land-based pit discharging station 120 may be used according to the methods and systems described herein.

Fluid communication is provided between land-based pit discharging station 120 and pressurized container 110 via a conduit 125. As explained above with respect to conduit 115, design aspects of conduit 125 may vary depending on the requirements of a specific transfer operation.

In the illustrated embodiment, a valve 130 is disposed in conduit 125 between pressurized container 110 and land-based pit discharging station 120. Valve 130 may be used to control the flow of drill cuttings between pressurized container 110 through conduit 125, and through various discharge conduits 135 and 140. Multiple discharge conduits 135 and 140 may be used to direct a flow of drill cuttings evenly throughout land-based pit discharging station 120. Those of ordinary skill in the art will appreciate that more than two discharge conduits 135 and 140 may be used by using multiple valves 130. For example, in an alternative embodiment, additional valves 130 may be disposed in fluid communication with discharge conduits 135 and 140, thereby allowing drill cuttings to be discharged at, for example, double the locations. Such embodiments may thereby increase the efficiency of disposing drill cuttings evenly in the land-based pit discharging station 120.

Figure 5C:
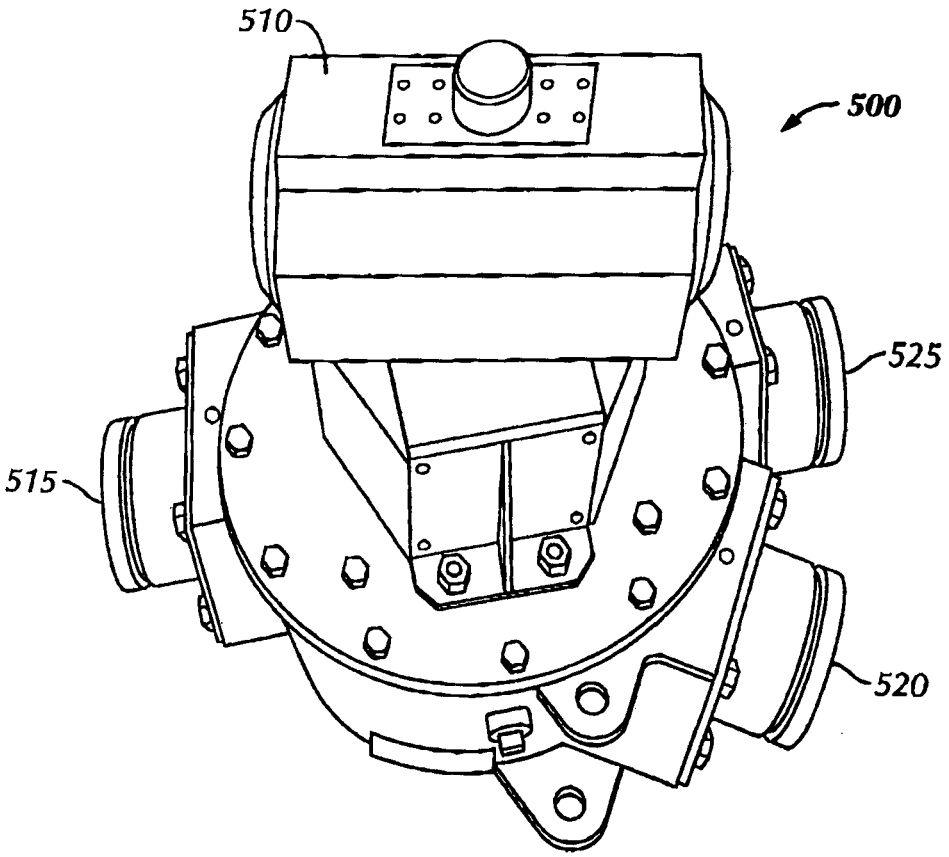
FIG. 5C is a perspective view of an R-valve according to embodiments of the present disclosure.

In certain embodiments, valve 130 in FIG. 1 and/or valves 630, 730, 830, and 1130 in corresponding FIGS. 6, 7, 8, and 10 may be an R-valve, such as the R-Valve commercially available from M-I L.L.C., a Schlumberger Company, Houston, Tex. Referring briefly to FIG. 5C, a perspective view of an R-valve is shown. R-valve 517 is an enclosed valve operated through the use of compressed air. R-valve includes a pneumatic actuator 510, an inlet 515, a through outlet 520, and a divert outlet 525. The pneumatic actuator 510 may be controlled to direct the flow of drill cuttings through R-valve 500 to either through outlet 520 or divert outlet 525 in order to direct the flow of drill cuttings to a desired location. R-valves may be used in order to provide full-bore transfer, thereby allowing drill cuttings to be transferred more efficiently.

Referring back to FIG. 1, those of ordinary skill in the art will appreciate that in certain embodiments, multiple valves 130 may be disposed between multiple pressure containers 110, thereby providing multiple flow arrangements of drill cuttings through the system.

Figure 6:
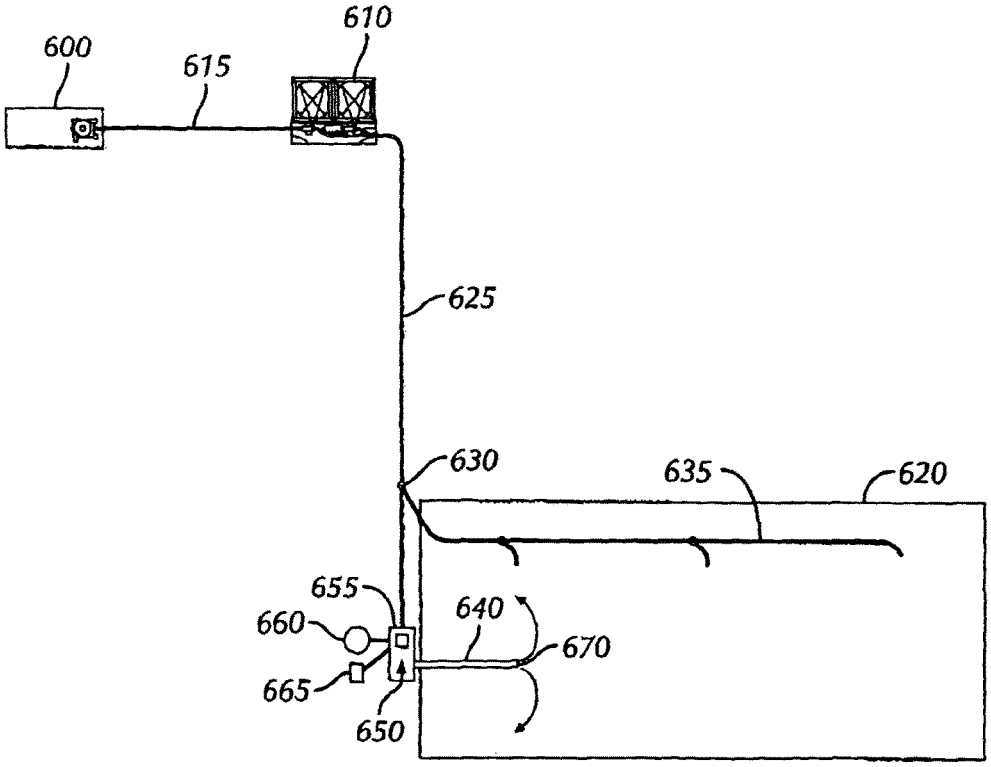
FIG. 6 is a schematic representation of a system for transporting drill cuttings at a land-based drilling location according to embodiments of the present disclosure.

Referring to FIG. 6, a schematic representation of an alternate system for transporting drill cuttings at a land-based drilling location is shown. The components of the system of FIG. 6 include a pressurized transfer device 600 and one or more pressurized containers 610, fluidly connected through a conduit 615. The system further includes a conduit 625 providing fluid communication between pressurized containers 610 and a land-based pit discharging station 620. At one or more locations along conduit 625, one or more valves 630 may be disposed and configured to direct a flow of drill cuttings to a particular location.

In this embodiment, valve 630 may be used to direct a flow of drill cuttings from pressurized container 610 to land-based pit discharging station 620 via discharge conduit 635. Alternatively, valve 630 may be used to direct a flow of drill cuttings from pressurized container 610 to a treatment station 650. Treatment station 650 may include various components in order to treat the drill cuttings prior to discharging the drill cuttings into land-based pit discharging station 620. As illustrated, in this embodiment, treatment station includes a mill 655, such as a pug mill or hammer mill in fluid communication with valve 630. Mill 655 may be used to process the drill cuttings in order to decrease the size of the drill cuttings.

At the same time or after mill 655 is actuated to pulverize the drill cuttings, a binder may be introduced to the drill cuttings. Introduction of the binder may cause the drill cuttings to bind together. As illustrated, the binder may be introduced to the drill cuttings through a silo 660, which may allow for the bulk treatment of drill cuttings. In certain embodiments, manual introduction of a binder may be provided through a manual treatment location 665. Those of ordinary skill in the art will appreciate that one or more of manual and/or bulk treatment may be used according to the embodiments disclosed herein.

After introduction of the binder with the drill cuttings, the drill cuttings may be conveyed through a discharge conduit 640 for discharge into the land-based pit discharging station 630. In certain embodiments, discharge conduit 640 may include a turret style cuttings conveyor 670, thereby allowing drill cuttings to be discharged evenly in land-based pit discharging station 630, or otherwise allow an operator control over where the drill cuttings are discharged.

In certain embodiments, various types of binders may be introduced to drill cuttings. In certain embodiments, the binder may include fly ash. In other embodiments, Portland cement may be introduced with or without the fly ash, thereby resulting in the formation of a drill cuttings concrete. The resultant concrete may either be disposed in the land-based pit discharging station 620 or otherwise used in other aspects of the drilling operation, such as for road construction or base construction. The resultant concrete may also be formed into monolithic structures and disposed at an alternative location.

Figure 7:
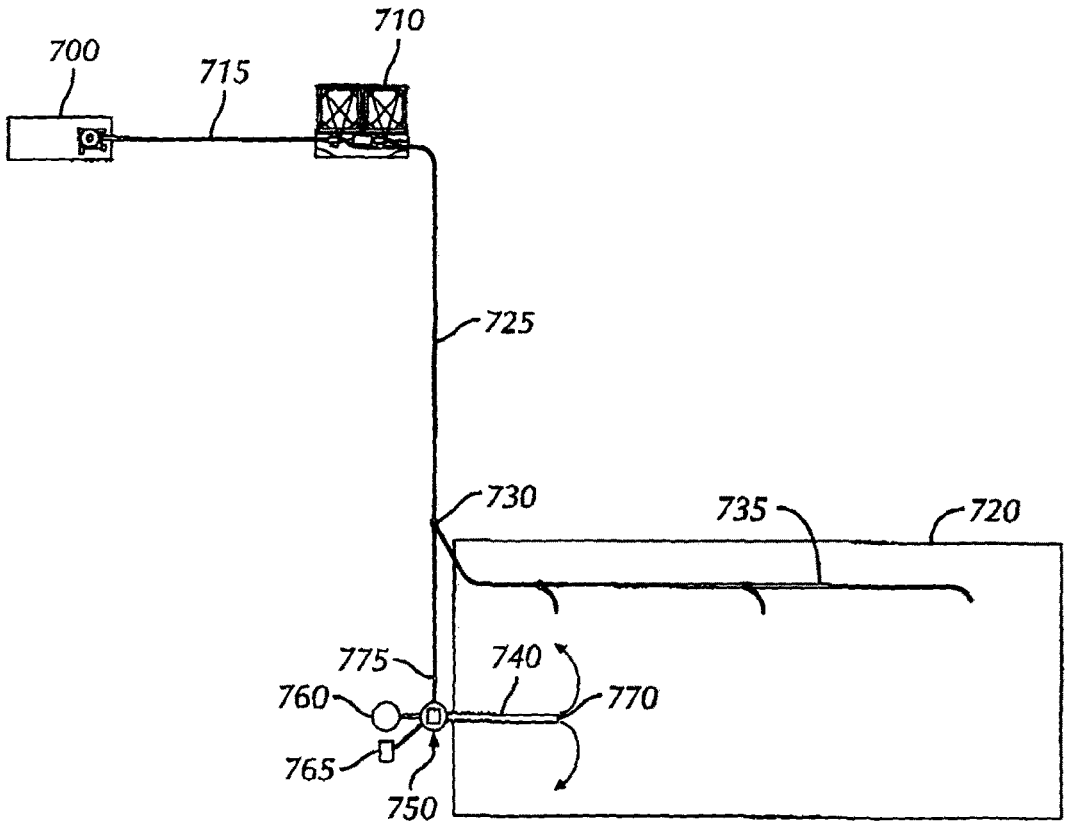
FIG. 7 is a schematic representation of a system for transporting drill cuttings at a land-based drilling location according to embodiments of the present disclosure.

Referring to FIG. 7, a schematic representation of an alternate system for transporting drill cuttings at a land-based drilling location is shown. The components of the system of FIG. 7 include a pressurized transfer device 700 and one or more pressurized containers 710, fluidly connected through a conduit 715. The system further includes a conduit 725 providing fluid communication between pressurized containers 710 and a land-based pit discharging station 720. At one or more locations along conduit 725, one or more valves 730 may be disposed and configured to direct a flow of drill cuttings to a particular location.

In this embodiment, valve 730 may be used to direct a flow of drill cuttings from pressurized container 710 to land-based pit discharging station 720 via discharge conduit 735. Alternatively, valve 730 may be used to direct a flow of drill cuttings from pressurized container 710 to a treatment station 750. Treatment station 750 may include various components in order to treat the drill cuttings prior to discharging the drill cuttings into land-based pit discharging station 720. As illustrated, in this embodiment, treatment station 750 includes a mixing cone 775 configured to receive a binder from either a bulk treatment silo 760 or from a manual treatment location 765.

After introduction of the binder with the drill cuttings, the drill cuttings may be conveyed through a discharge conduit 740 for discharge into the land-based pit discharging station 720. In certain embodiments, discharge conduit 740 may include a turret style cuttings conveyor 770, thereby allowing drill cuttings to be discharged evenly in land-based pit discharging station 730, or otherwise allow an operator control over where the drill cuttings are discharged.

Figure 8:
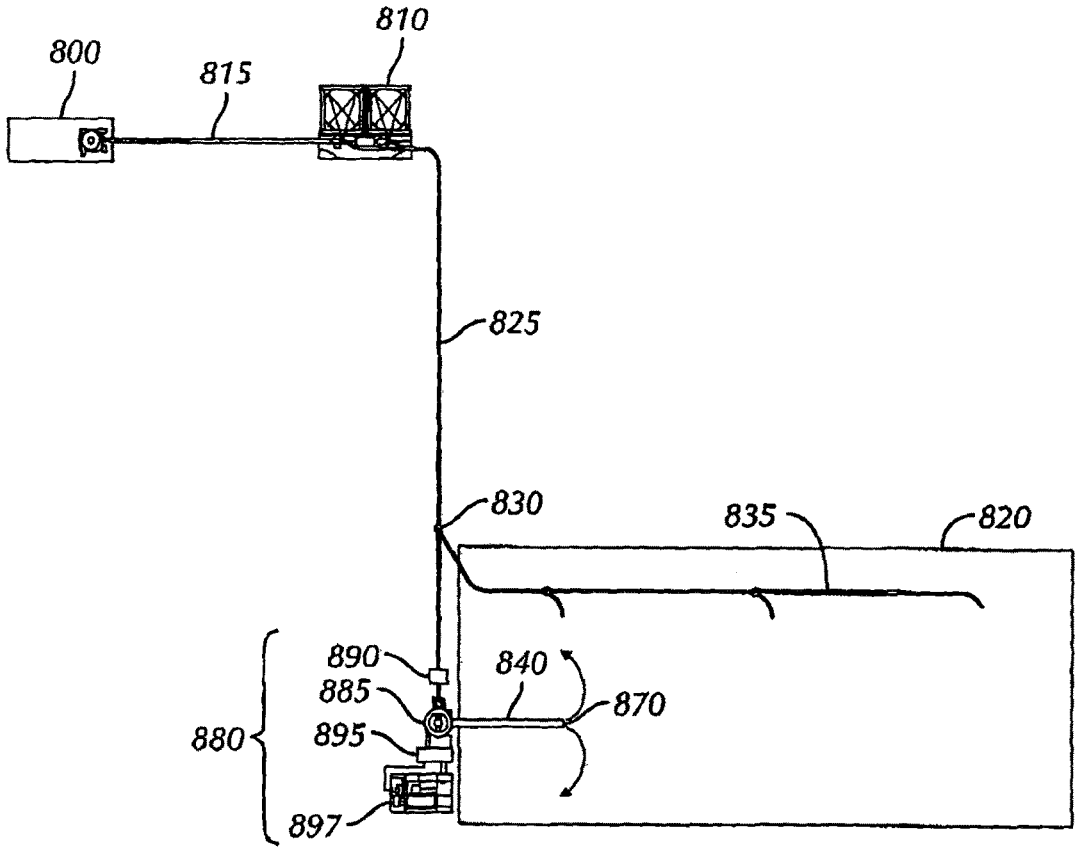
FIG. 8 is a schematic representation of a system for transporting drill cuttings at a land-based drilling location according to embodiments of the present disclosure.

Referring to FIG. 8, a schematic representation of an alternate system for transporting drill cuttings at a land-based drilling location is shown. The components of the system of FIG. 8 include a pressurized transfer device 800 and one or more pressurized containers 810, fluidly connected through a conduit 815. The system further includes a conduit 825 providing fluid communication between pressurized containers 810 and a land-based pit discharging station 820. At one or more locations along conduit 825, one or more valves 830 may be disposed and configured to direct a flow of drill cuttings to a particular location.

In this embodiment, valve 830 may be used to direct a flow of drill cuttings from pressurized container 810 to land-based pit discharging station 820 via discharge conduit 835. Alternatively, valve 830 may be used to direct a flow of drill cuttings from pressurized container 810 to a separator 880. As illustrated, in this embodiment, separator 880 includes a material dryer 885.

Figure 9:
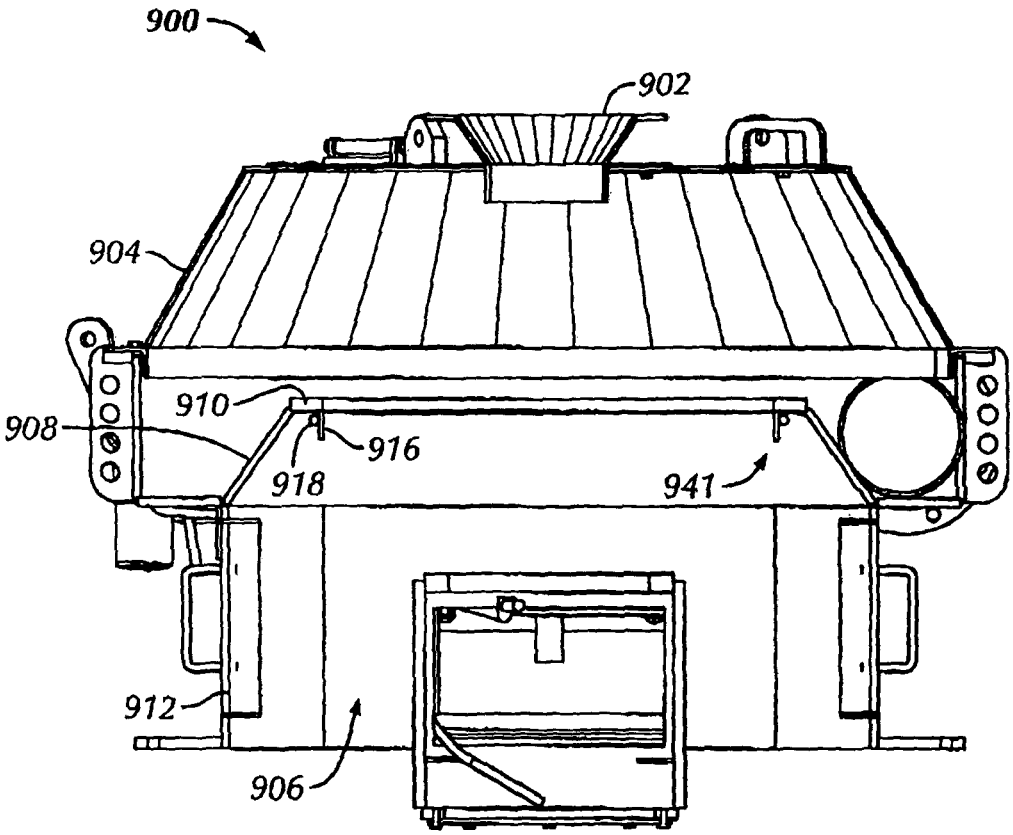
FIG. 9 is a side view of a material dryer according to embodiments of the present disclosure.

Referring briefly to FIG. 9, a cross sectional view of a material dryer 900 in accordance with embodiments disclosed herein is shown. One example of a commercially available dryer is the Verti-G Dryer from M-I L.L.C., a Schlumberger Company, Houston, Tex. Material dryer 900 may include an inlet 902 configured to receive drill cuttings, and may further include a separator assembly 904 to separate the drill cuttings into a solids phase and a liquid phase. In certain embodiments, separator assembly 904 may include, for example, a flight and screen assembly (not shown), as discussed above. The separated solids phase may be collected in a solids discharge chamber 906 having an outer circumferential wall 908.

A flushing system 914 may be disposed within material dryer 900 and may be mounted on a top surface 910 of solids discharge chamber 906. In certain embodiments, flushing system 914 may be fixed to top surface 910 using welds, adhesives, or mechanical fasteners. For example, support ring 916 may be welded to top surface 910 of solids discharge chamber 906. In alternate embodiments, tubing ring 918 may be directly attached to top surface 910 of solids discharge chamber 906 using, for example, brackets, welding, or adhesives. Top surface 910 of solids discharge chamber 906 may be disposed below a rotor (not shown) in separator assembly 904. A fluid supply line (not shown) may be connected to tubing ring 918 through an outer housing 912 of material dryer 900 such that the fluid supply line may be in fluid communication with inner diameter of tubing ring 918. In select embodiments, a control valve (not shown) may be disposed in the fluid supply line such that the fluid flow rate may be controlled.

Referring back to FIG. 8, prior to drill cuttings being conveyed to material dryer 885 drill cuttings may be transferred through an impingement box 890. Impingement box 890 may be used to separate large and/or agglomerated masses of drill cuttings prior the drill cuttings entering material dryer 885. After drill cuttings pass through impingement box 890, the drill cuttings enter material dryer, where effluents are separated from solid phase. The separated solid phase may be conveyed through a discharge conduit 840 for discharge into the land-based pit discharging station 820. In certain embodiments, discharge conduit 840 may include a turret style cuttings conveyor 870, thereby allowing drill cuttings to be discharge evenly in land-based pit discharging station 830, or otherwise allow an operator control over where the drill cuttings are discharged.

The separated effluent phase may flow from material dryer to an effluent tank 895, after which the effluent phase may be further processed through a secondary separator 897. In certain embodiments, secondary separator 897 may include a centrifuge, hydrocyclone, or other separator for separating fine solids from the effluent phase. The separated fine solids may be transferred to land-based pit discharging station 820 via an alternate conduit (not shown), while separate effluent phase may be recycled for reuse in the active drilling fluid system.

Figure 10:
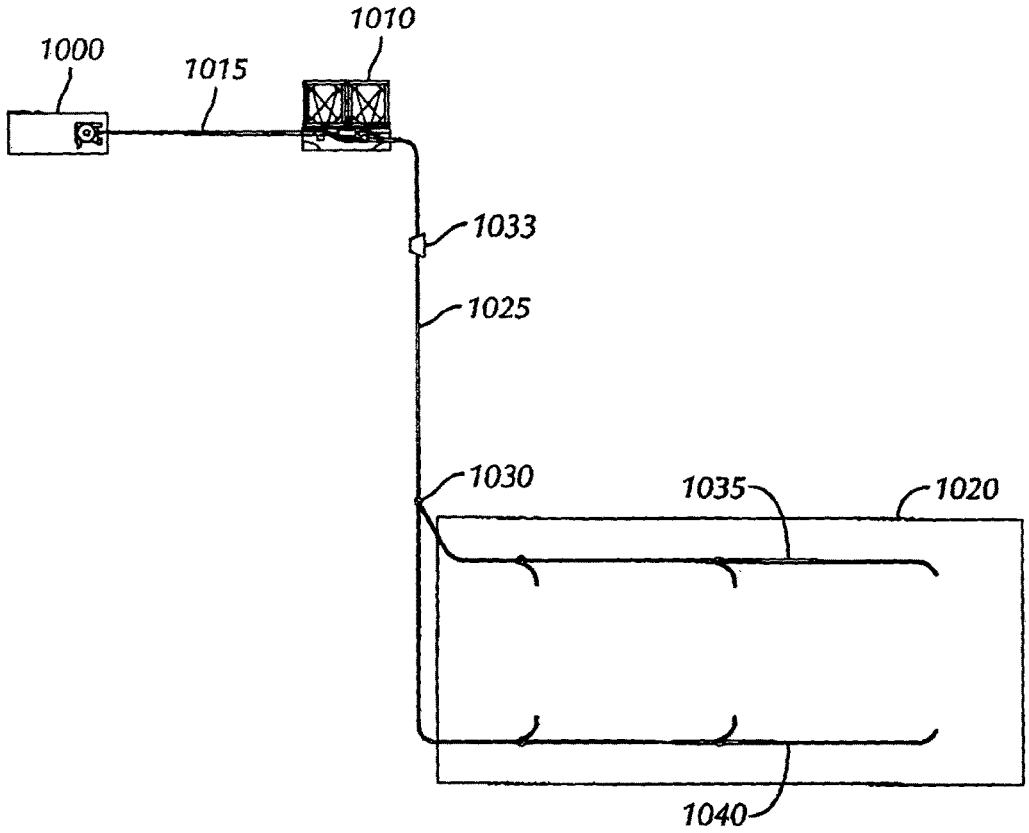
FIG. 10 is a schematic representation of a system for transporting drill cuttings at a land-based drilling location according to embodiments of the present disclosure.

Referring to FIG. 10, a schematic representation of an alternate system for transporting drill cuttings at a land-based drilling location is shown. The components of the system of FIG. 10 include a pressurized transfer device 1000 and one or more pressurized containers 1010, fluidly connected through a conduit 1015. The system further includes a conduit 1025 providing fluid communication between pressurized containers 1010 and a land-based pit discharging station 1020. At one or more locations along conduit 1025, one or more valves 1030 may be disposed and configured to direct a flow of drill cuttings to a particular location. Multiple discharge conduits 1035 and 1040 may be used to direct a flow of drill cuttings evenly throughout land-based pit discharging station 1020. Those of ordinary skill in the art will appreciate that more than two discharge conduits 1035 and 1040 may be used by using multiple valves 1030. For example, in an alternative embodiment, additional valves 1030 may be disposed in fluid communication with discharge conduits 1035 and 1040, thereby allowing drill cuttings to be discharged at, for example, double the locations. Such embodiments may thereby increase the efficiency of disposing drill cuttings evenly in the land-based pit discharging station 1020.

In this embodiment, an eductor 1033 may be disposed inline along conduit 1025. Eductor 1033 may be used to add a binder, or other treatment to drill cuttings as the drill cuttings are transferred from pressure container 1010 to land-based pit discharging station 1020. By mixing a binder, such as fly ash, or other treatments in eductor 1033, the treatments may be injected inline during the transference of the drill cuttings. Thus, eductor 1033 may be used to substantially continuously mix treatments with the drill cuttings, thereby allowing the drill cuttings to have optimized properties when discharged into land-based pit discharging station 1020. In still other embodiments an eductor 1033 or other mixing device may be disposed along discharge conduits 1035 and/or 1040, or at any other point along the conduit prior to the drill cuttings being discharged into land-based pit discharging station 1020.

Still referring to FIG. 10, in certain embodiments, the length of conduits 1015 and 1025 may be varied in order to accommodate changes in the drilling operation. Those of ordinary skill in the art will appreciate that during drilling operations, often times, multiple wells are drilled while a single land-based pit discharging station 1020 is used to dispose of the produced drill cuttings from the various wells. Embodiments of the present disclosure may be used to create a centralized disposal and/or treatment location. Because additional lengths of conduit 1015 and 1025 may be added or removed, as wells are drilled at different locations, the conduit may be adjusted, while still maintaining a centralized land-based pit discharging station 1020. For example, a first well may be drilled 150 feet from the land-based pit discharging station 1020. The drill cuttings from the first well may initially be pneumatically transferred to land-based pit discharging station 1020, as described above.

When the first well is complete, a second well may be drilled at, for example, 900 feet from the land-based pit discharging station 1020. Thus, additional conduits 1015 and 1025, as well as additional pressurized containers 1010, may be used to allow transference of drill cuttings from the second well location to the land-based pit discharging station 1020. As the pneumatic transference between pressurized containers 1010 may be limited, it may be necessary to add additional pressurized containers 1010 to allow effective transference from wells at large distances from land-based pit discharging station 1020. For example, pressurized containers may be limited to pneumatically transferring drill cuttings approximately 300 meters. Thus, if a well is located more than 300 meters from the land-based pit discharging station 1020, it may be necessary to have additional pressurized containers 1010 disposed inline, thereby increasing the distance the drill cuttings may be pneumatically transferred. As the drilling location of specific wells changes, the pressurized containers 1010 and conduits 1015 and 1025 may be relocated. Those of ordinary skill in the art will appreciate that pneumatic transfer device 1000 may also be relocated with the pressurized containers 1010 and conduits 1015 and 1025.

In addition to allowing drill cuttings to be transferred from various drilling locations to a centralized land-based pit discharging station 1020, embodiments of the present disclosure may also allow for the substantially continuous processing of drill cuttings while drilling. For example, as drilling produces drill cuttings, the cuttings may be conveyed into the system for transference to land-based pit discharging station 1020. The cuttings may thus be efficiently transferred and treated, if necessary, thereby substantially continuously transferring, treating, and disposing of drill cuttings. Because the transference, treatment, and disposing occurs continuously throughout drilling, an accumulation of drill cuttings at the drilling location may be prevented.

Advantageously, embodiments of the present disclosure may provide for a centralized drill cuttings disposal location. The disposal location may further allow for the treatment of drill cuttings prior to disposal. Also advantageously, embodiments of the present disclosure may provide for more efficient transfer and treatment of drill cuttings prior to disposal. Further, embodiments of the present disclosure may provide for the pneumatic transfer of drill cuttings, which decreases the use of front end loaders and results in the safer handling of drill cuttings.

Also advantageously, embodiments of the present disclosure may provide for the centralized processing of drill cuttings. By centralizing the drill cuttings processing, less environmental hazards may occur, such as decreased chances for oil spills, broken pipes, etc. Additionally, centralizing drill cuttings processing may allow for greater reliability in poor weather conditions, such as when snow or ice is on the ground. In such poor weather conditions typical drill cuttings disposal methods would require trucks to drive over the snow or ice, risking accidental spills or overturn of the trucks. By centralizing the drilling cuttings processing and using pneumatic transference, the pipeline carrying the drilling cuttings can continue to operate without regard to the poor weather conditions, thereby advantageously increasing the reliability of the drilling cuttings transfer and processing.

Advantageously, embodiments of the present disclosure may further allow for less equipment to be moved at a drilling location. For example, by centralizing the drill cuttings processing, the processing equipment may remain stationary at the land-based pit discharging station. In situations where the land-based pit discharging station remains stationary, equipment associated with the processing of drill cuttings, such as mills, binder silos, etc. may remain in place throughout the drilling of multiple wells. In order to accommodate wells drilled in multiple locations, the pipeline connecting the pneumatic transfer devices may be extended by adding additional piping and the pressurized transference device and pressurized container may be moved to a new drilling location. Thus, rather than require all of the equipment be moved in order to facilitate the drilling of multiple wells, a centralized drilling processing location may result in minimal equipment transference, advantageously decreasing safety and environmental hazards.

Also advantageously, embodiments of the present disclosure may provide for the processing of drill cuttings from multiple wells simultaneously. In such embodiments, multiple pressurized transference devices and/or multiple pressurized containers may be present at more than one drilling location. As drill cuttings are produced at the multiple drilling locations, the drill cuttings may be transferred simultaneously to the centralized drill cuttings processing location. By allowing for drill cuttings from multiple wells to be processed at the same time, drill cuttings will spend less time at the drilling location, advantageously decreasing environmental risks associated unprocessed drill cuttings.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A method of transferring drill cuttings, the method comprising:

transferring the drill cuttings from a pressurized transference device to a pressurized container;

transferring, via positive pneumatic transference, the drill cuttings from the pressurized container to a land-based pit discharging station, through a first discharge conduit having at least one first discharge location within the land-based pit discharging station and a second discharge conduit having at least one second discharge location within the land-based pit discharging station;

controlling an enclosed valve, that is operated through use of compressed air and provided between the pressurized container and the first and second discharge conduits and land-based pit discharging station, to change between the at least one first and at least one second discharge locations that the drill cuttings are discharged within the land-based pit discharging station by controlling the first and second discharge conduits through which the drill cuttings flow into the land-based discharging station, wherein the valve comprises an inlet, a first outlet, a second outlet and a pneumatic actuator, wherein the pneumatic actuator is controlled to direct the flow of the drill cuttings through the valve to the first outlet of the valve such that the drill cuttings are discharged at and/or to the at least one first discharge location or to the second outlet of the valve such that the drill cuttings are discharged at and/or to the at least one second discharge location; and discharging the drill cuttings at the at least one first and at least one second discharge locations into the land-based pit discharging station through the first and second discharge conduits controlled by the valve.

2. The method of claim 1, further comprising:

grinding the drill cuttings in a mill.

3. The method of claim 2, wherein the mill is located between the pressurized container and the land-based pit discharging station.

4. The method of claim 2, further comprising:

treating the drill cuttings with a binder.

5. The method of claim 4, wherein the binder comprises fly ash.

6. The method of claim 4, further comprising:

adding the binder in-line between the pressurized container and the mill.

7. The method of claim 1, further comprising:

adding a binder in-line between the pressurized container and the land-based pit discharging station.

8. The method of claim 1, further comprising:

drying the drill cuttings in a material dryer, wherein the material dryer is disposed between the pressurized container and the land-based pit discharging station.

9. The method of claim 8, further comprising:

separating an effluent from the drill cuttings.

10. The method of claim 1, further comprising:

drilling a wellbore, wherein the transferring the drill cuttings occurs during the drilling.

11. The method of claim 10, wherein the transferring the drill cuttings is substantially continuous.

12. The method of claim 1, further comprising transferring the drill cuttings from the pressurized container to a second pressurized container.

13. The method of claim 12, further comprising adjusting a length of conduit between the pressurized container and the second pressurized container.

14. The method of claim 1, wherein a length of conduit is adjusted based on a location of a wellbore.

15. The method of claim 1, further comprising:

transferring the drill cuttings from a plurality of wells to the land-based pit discharging station.

16. The method of claim 15, wherein the drill cuttings are processed by at least one selected from a group consisting of grinding the drill cuttings in a mill, treating the drill cuttings with a binder, adding a binder in-line between the pressurized container and a mill, adding a binder in-line between the pressurized container and the land-based pit discharging station, drying the drill cuttings in a material dryer, and separating an effluent from the drill cuttings.

17. The method of claim 15, further comprising:

moving at least one of the pressurized transference device and the pressurized container between the plurality of wells.

18. A system for transferring drill cuttings while drilling, the system comprising:

a pressurized positive pneumatic transfer device;

a pressurized container in fluid communication with the pressurized positive pneumatic transfer device;

a first intermediate conduit disposed between the pressurized positive pneumatic transfer device and the pressurized container;

at least two discharge conduits having at least one first discharge location and at least one second discharge location within a land-based pit discharging station;

the land-based pit discharging station in fluid communication with the pressurized container; and an enclosed valve disposed in a second intermediate conduit between the pressurized container and the at least two discharge conduits and the land-based pit discharging station and operable through use of compressed air such that the valve fluidly connects the pressurized container and the at least two discharge conduits, wherein the valve is configured to change between the at least one first and at least one second discharge locations for discharging the drill cuttings within the land-based pit discharging station, and wherein changing between the at least one first and at least one second discharge locations where the drill cuttings are discharged comprises controlling the at least two discharge conduits through which the drill cuttings flow, wherein the valve comprises an inlet, a first outlet, a second outlet and a pneumatic actuator, wherein the pneumatic actuator is controllable to direct the flow of the drill cuttings through the valve to the first outlet of the valve such that the drill cuttings are discharged at and/or to the at least one first discharge location or to the second outlet of the valve such that the drill cuttings are discharged at and/or to the at least one second discharge location.

19. The system of claim 18, further comprising a second pressurized container in fluid communication with the pressurized container and the land-based pit discharging station.

20. The system of claim 18, further comprising:

a mill disposed between the pressurized container and the land-based pit discharging station, wherein the mill is in fluid communication with the pressurized container.

21. The system of claim 20, further comprising:

an eductor in fluid communication with the mill, wherein the eductor is configured to introduce a binder into the mill.

22. The system of claim 18, further comprising:

an eductor in fluid communication with the conduit, wherein the eductor is configured to introduce a binder into the conduit.

* * * * *